US008256068B2

(12) United States Patent
West

(10) Patent No.: US 8,256,068 B2
(45) Date of Patent: Sep. 4, 2012

(54) MICROHOOK FASTENER APPARATUS

(75) Inventor: David W. West, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 792 days.

(21) Appl. No.: 12/262,376

(22) Filed: Oct. 31, 2008

(65) Prior Publication Data

US 2009/0126165 A1 May 21, 2009

Related U.S. Application Data

(60) Provisional application No. 60/988,501, filed on Nov. 16, 2007.

(51) Int. Cl.
*A44B 18/00* (2006.01)

(52) U.S. Cl. ..... 24/450

(58) Field of Classification Search ..... 24/442, 24/447, 448, 450, 452; 428/99, 100; 604/391
See application file for complete search history.

(56) References Cited

U.S. PATENT DOCUMENTS

| | | | | |
|---|---|---|---|---|
| 3,147,528 | A | 9/1964 | Erb | |
| 3,270,408 | A | 9/1966 | Nealis | |
| 3,408,705 | A | 11/1968 | Kayser et al. | |
| 4,169,303 | A | 10/1979 | Lemelson | |
| 5,457,855 | A * | 10/1995 | Kenney et al. | 24/445 |
| 5,596,794 | A * | 1/1997 | Shibanushi | 24/452 |
| 5,607,635 | A | 3/1997 | Melbye et al. | |
| 5,625,929 | A | 5/1997 | Hattori et al. | |
| 5,713,111 | A | 2/1998 | Hattori et al. | |
| 5,761,775 | A | 6/1998 | Legome et al. | |
| 6,044,525 | A | 4/2000 | Sastre et al. | |
| 6,162,040 | A | 12/2000 | Clune | |
| 6,287,665 | B1 | 9/2001 | Hammer | |
| 6,627,133 | B1 | 9/2003 | Tuma | |
| 6,687,962 | B2 | 2/2004 | Clarner et al. | |
| 6,708,378 | B2 | 3/2004 | Parellada et al. | |
| 7,007,351 | B2 | 3/2006 | Ausen et al. | |

(Continued)

FOREIGN PATENT DOCUMENTS

EP 1762152 A1 3/2007

(Continued)

*Primary Examiner* — James Brittain
(74) *Attorney, Agent, or Firm* — Robert A. McCann; Christopher S. Clancy; James H. Williams

(57) ABSTRACT

A microhook and loop fastening and detaching assembly comprising a web including a plurality of malleable loops formed integral with one surface of the web, and a plurality of hooks attached to another surface of the web, wherein the loops are adapted to removably engage the hooks. The hooks are equidistantly-arrayed in a plurality of linear rows on the hook side of the web in a staggered manner across the width of the web, such that each hook in a given row is located between two hooks of an adjacent row. The centerline distance between hooks in adjacent rows in the machine direction of the web is greater than the equidistant centerline dimension between adjacent hooks in the same cross-web row. Each hook includes a pedestal attached to the hook side of the web, and a head portion forming part of the pedestal. The head portion extends in a radial direction beyond the radial extent of the pedestal, and the head portion comprises a flat horizontal underside, or a slightly canted underside extending from a radiused connection between the head portion and the pedestal to a rim of the head portion.

6 Claims, 5 Drawing Sheets

U.S. PATENT DOCUMENTS

| | | | | |
|---|---|---|---|---|
| 7,037,457 | B2 | 5/2006 | Seidel et al. | |
| 7,048,527 | B2 | 5/2006 | Bay et al. | |
| 7,052,636 | B2 | 5/2006 | Ausen et al. | |
| 7,052,638 | B2 | 5/2006 | Clarner et al. | |
| 7,108,814 | B2 | 9/2006 | Herrero et al. | |
| 7,120,973 | B2 | 10/2006 | Ducauchuis | |
| 7,198,743 | B2 | 4/2007 | Tuma | |
| 7,223,314 | B2 | 5/2007 | Provost | |
| 7,275,290 | B2 | 10/2007 | Clarner et al. | |
| 2003/0085492 | A1 | 5/2003 | Schulte | |
| 2003/0126724 | A1* | 7/2003 | Kono et al. | 24/451 |
| 2003/0224137 | A1 | 12/2003 | Chung | |
| 2004/0119193 | A1 | 6/2004 | Parellada et al. | |
| 2005/0015938 | A1 | 1/2005 | Shepard et al. | |
| 2005/0091805 | A1* | 5/2005 | Armela et al. | 24/452 |
| 2005/0244756 | A1 | 11/2005 | Clarner | |
| 2007/0063375 | A1 | 3/2007 | Tuma | |
| 2007/0077390 | A1* | 4/2007 | Yang | 428/99 |
| 2007/0113385 | A1 | 5/2007 | Martin et al. | |

FOREIGN PATENT DOCUMENTS

| | | | |
|---|---|---|---|
| FR | 2364004 | A1 | 4/1978 |
| WO | 0225789 | A2 | 3/2002 |

* cited by examiner

MICROHOOK FASTENER APPARATUS

CROSS-REFERENCE TO RELATED APPLICATION

This patent application claims priority to provisional application Ser. No. 60/988,501, filed Nov. 16, 2007, to the extent allowed by law.

FIELD OF THE INVENTION

The present invention relates to an improved microhook apparatus for use in extruded hook and loop fasteners having a low profile and, more particularly, to the geometry, configuration and spacing of mushroom-shaped hooks that produce a fastener having greater flexibility, reduced flagging, and increased pick and peel resistance.

BACKGROUND OF THE INVENTION

Extruded hook and loop fasteners having a hook presenting a low profile, or low overall thickness of approximately 0.035 inches, are currently marketed and referred to as microhooks. Flexible webs comprising microhooks are increasingly being used for a variety of purposes, including to tie a plurality of electrical cables together, which require greater holding strength than fasteners used, for example, in disposable hygiene products. Microhook fasteners used for cable management must be designed with the geometry, spacing and structure to provide flexibility to conform to the perimeter of cable bundles, to prevent flagging by providing that the ends of the hook and loop fastener remain attached to the curvature of the cable bundle, while at the same time providing sufficient pick and peel resistance to prevent the fastener from being inadvertently released if bumped or brushed against, or otherwise impacted, after application.

SUMMARY OF THE INVENTION

A microhook for use in cable management, in an embodiment, includes a plurality of "mushroom" shaped hook elements attached to one side of a web. The mushroom hooks are arrayed on the hook side of the web of the microhook fastener such that the centerline-to-centerline spacing of the mushroom hooks in the lengthwise, or machine, direction is significantly greater than the spacing between mushroom hooks in the cross-web direction. Additionally, the array of mushroom hooks on the hook side of the web is staggered in successive rows in the machine direction such that each hook is aligned with the space between hooks in the adjacent rows in the cross-web direction. In another embodiment, the underside of the head of each mushroom hook is substantially flat, and horizontal or canted slightly downward in the radially outward direction. A limited radius at the junction between the head and the pedestal of each hook provides stress relief.

BRIEF DESCRIPTION OF THE DRAWINGS

Certain examples of the present invention are illustrated by the accompanying figures. It should be understood that the figures are not necessarily to scale and that details that are not necessary for an understanding of the invention, or that render other details difficult to perceive, may be omitted. It should be understood, of course, that the invention is not necessarily limited to the particular examples illustrated herein.

DETAILED DESCRIPTION

Figure 1:
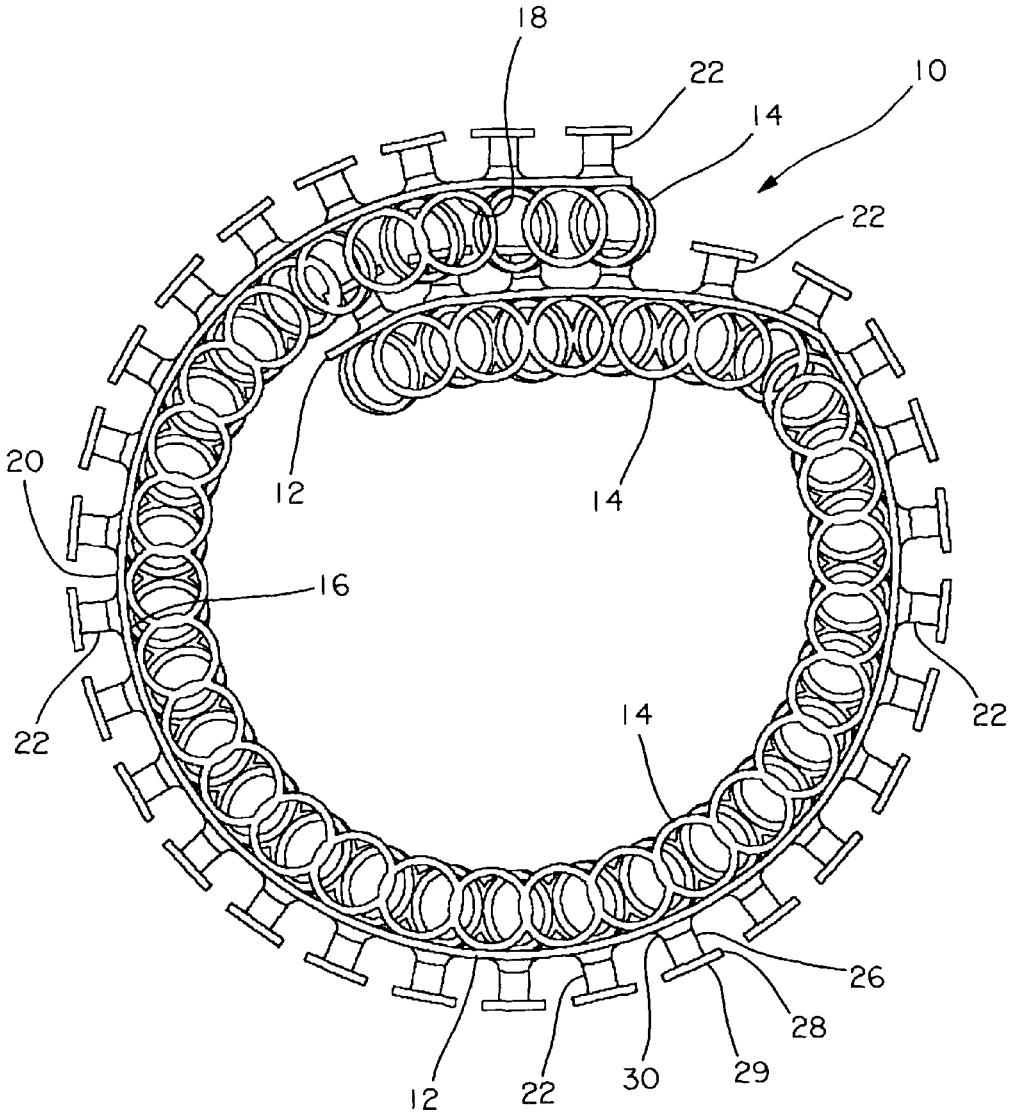
FIG. 1 is a cross-sectional view of the hook and loop fastener of the present invention showing the shape of the fastener were it assembled around a wire bundle or such other item.

Referring to FIG. 1, an embodiment of the present invention is illustrated. In the embodiment shown, microhook and loop fastener assembly 10 comprises a flexible web 12 made of a knitted fabric material with a plurality of malleable loops 14 integrally formed on loop side 16 of the web, such that the loops 14 extend generally outward from the loop side 16 of web 12. The loops 14 are flexible, and are made of material that tends to maintain a random open shape of each loop when in its unstressed configuration. The loops 14 are typically made of a plastic material, such as nylon or a polyester, by way of example. Additionally, the loops could be made of a non-woven textile composed of polypropylene or polyester. The loops 14 are integrally formed at their bases 18 to loop side 16 of the web 12.

The hook and loop fastener assembly 10 also comprises a hook side 20 of web 12, with a plurality of mushroom-shaped hooks 22 securely fastened to hook side 20 of web 12. Alternatively, hooks 22 may be integrally formed with web 12. Referring to FIGS. 1, 2, 3 and 5, each mushroom-shaped hook 22 comprises a pedestal or base 26, and a disc or head portion 28 formed with or attached to pedestal 26. The lower segment of each pedestal 26 includes a slightly radiused portion 30 where the pedestal 26 is firmly attached to or formed with, side 20 of web 12. The limited radius 30 acts to prevent the hooks 22 from breaking off of web 12, while providing each hook with a slight bending capability. As will be described in further detail, the attachment of the base of each pedestal 26 does not increase the rigidity of the web 12. This is due to the relatively small radius 30 where the pedestal 26 joins web 12 and the staggering of the mushroom hooks on web 12, as shown in FIG. 4 and subsequently described herein. Disc or head 28 is formed at the top of each pedestal 26, and in the illustrated embodiment, each head 28 is round in plan view, as seen in FIG. 4, providing each hook 22 with a three hundred sixty degree loop engaging surface to facilitate engagement of a loop in any direction. The head 28 of each pedestal could also be other shapes, such as generally octagonal, hexagonal, square or the like. The web 12 with integral, or attached, hooks 22 can be made of any moldable plastic resin material, such as but not limited to polypropylene, polyethylene and nylon. Also, flame retardant additives can be incorporated into these resins. The loops 14 and hooks 22 can be laminated into a single web with an adhesive, or can be integrally formed as part of the web.

Figure 3:
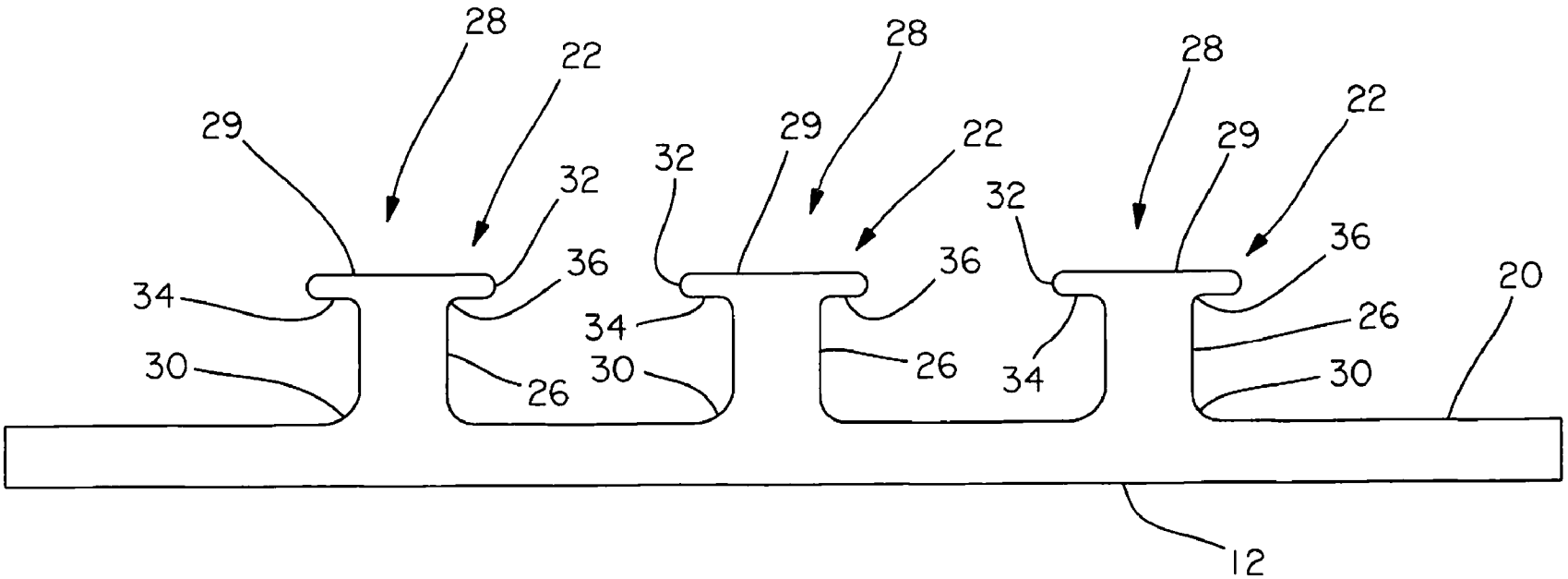
FIG. 3 is a cross-sectional view of a single row of hooks attached to the hook side of the web of the present invention, taken along the line III-III in FIG. 2.
Figure 4:
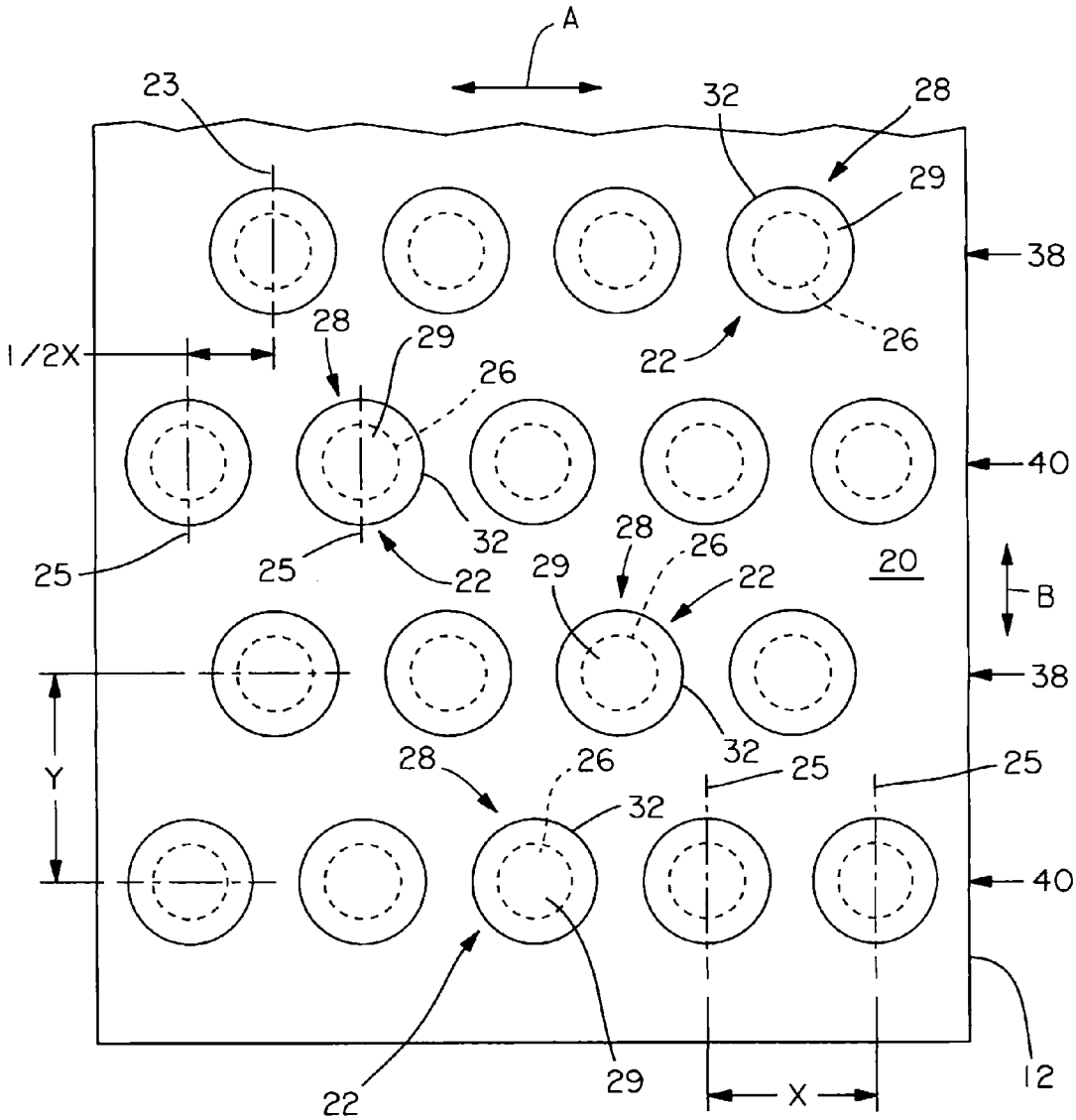
FIG. 4 is a top plan view of the pattern of hooks mounted to the hook side of the web of FIG. 1, shown arrayed in accordance with the present invention.

Referring to FIG. 3, each head 28 in the illustrated embodiment comprises an upper surface 29, a rounded outer rim 32, and a flat lower surface 34 extending in a radial direction from a top portion of pedestal 26 to the rounded outer rim 32. The flat lower surface 34 can extend horizontally, or can cant slightly downward in the radially outward direction. The junction between each flat surface 34 and pedestal 26 is formed with a limited radius 36 to accomodate stress relief between the head 28 and pedestal 26.

One of the objectives of the present invention is to provide a microhook and loop assembly 10 having optimum flexibility, allowing the assembly 10 to conform to bundles, such as an array of wires, around which the assembly 10 is installed. It has been determined that flexibility of the assembly can be increased by having a thinner flexible web 12, while at the same time having sufficient thickness to maintain the requisite tensile strength of the web to prevent breaking or tearing. Empirically it has been determined that an optimum thickness of the web 12 is in the range of 0.0045 inches to 0.0061 inches, based on data cable bundling considerations, and using polypropylene as the material for hooks 22. It is to be understood that other optimum thickness ranges would be applicable were other hook materials used, and the microhook and loop assembly were used for varying purposes.

In an embodiment of the present invention and as shown in FIG. 4, the flexibility of the microhook and loop assembly 10 is also significantly increased by applying a novel geometry to the placement of hooks on web 12. The cross-web and machine direction pattern between the mushroom hooks 22 in the present invention is devised to provide greater pick and peeling resistance between hooks 22 and loops 14, and a virtual elimination of flagging, or the tendency of the end of the hook and loop assembly 10 to become detached due to curvature of the bundle that the assembly is securing.

In the embodiment illustrated in FIG. 4, alternate rows 38, 40 of mushroom hooks 22 are formed on the hook side 20 of web 12 and each row 38, 40 comprises four hooks 22 and five hooks 22, respectively, extending in the cross-web direction designated by the arrow A. It is also within the scope of the present invention that the number of hooks 22 arrayed in the direction A in rows 38, 40 can be more or less than the four and five hooks, respectively, shown in FIG. 4. In the machine or lengthwise direction of the web 12, designated by the arrow B in FIG. 4, the columns of hooks 22 are staggered between the lengthwise columns of adjacent hooks 22. Thus, the centerline 23 of each hook 22 in the machine direction is disposed between the centerlines 25 of two hooks in an adjacent row, for reasons to be explained.

Referring again to FIG. 4, the cross-web centerline distance in the direction A between individual hooks is designated as X. In each adjacent row 38, 40, the centerline-to-centerline distance in the cross-web, or A, direction is designated as one-half X (½ X), whereby the centerline of each hook 22 in a given row is centrally disposed and directly in the middle of the centerlines of two side-by-side hooks 22 in adjacent cross-web rows.

In addition, the centerline distance between two adjacent hooks 22 in the machine, or B, direction is designated Y in FIG. 4. To provide the advantages in increased flexibility, reduced flagging and greater pick and peel resistance mentioned above, the distance Y is greater than the distance X. It has been determined in one embodiment that the distance Y should be in the range of about twenty-five percent greater than the distance X. However, under certain circumstances depending on materials the hooks 22 and loops 14 are made of, the dimensions of the hooks 22, the thickness of web 12, and the intended use of the hook and loop assembly 10, the dimension Y may vary, but is always greater than the dimension X. The Y direction is the direction the loops 14 engage the hooks 22 when the hook and loop assembly 10 is applied to a bundle. The increased spacing in the Y direction provides the web 12 with larger empty or hinge areas on the web between the rows 38, 40, which increases the ability of the web 12 to bend between the rows 38, 40 of hooks, resulting, in increased flexibility of the web 12 when in use.

Empirically, it has been determined that a cross-web centerline spacing X between hooks 22 of approximately 0.0263 inches provides the necessary number of hooks to prevent flagging with polypropylene as the hook material. Under other circumstances, contemplating differences in material and web thickness, the optimum cross-web centerline spacing X between hooks 22 may vary.

Empirically, it has also been determined that the dimension Y, the centerline distance between hooks in adjacent rows 38, 40 measured in the machine direction B (FIG. 4), should be approximately 0.0328 inches to provide increased flexibility to the web 12. This figure was obtained by multiplying the empirical 0.0263 inch dimension for X by 125%. Using these representative dimensions for X and Y in the above description results in an array of one hundred eighty mushroom hooks 22 per square centimeter, and simultaneously increases the flexibility of web 12 compared to an array of hooks 22 where the X and Y dimensions are substantially the same.

As seen in FIG. 4, the machine direction centerlines of hooks 22 in each sequential adjacent row 38, 40 are staggered or offset in the cross-web direction A by a distance of one-half X (½X) from the centerlines of hooks 22 in the prior and subsequent row 38, 40. This staggering increases the tangential edge distance between rims 32 of the hooks 22 in an adjacent row, compared to unstaggered rows of hooks. This increased distance allows more loops 14 to enter the spaces between the mushroom hooks 22, such that an increased number of loops 14 are captured by the array of hooks 22 when the hook and loop assembly 10 is in use, such as engaging a bundle of wires. The increased amount of loops 14 becoming engaged with hooks 22 provides additional peel strength, which is generally defined as the force required to separate the ends of web 12, as will be explained. The staggering of the mushroom hooks 22 also provides a greater pick resistance at the edge of the hook and loop assembly 10 when wrapped around a bundle, thereby preventing the condition known as flagging and keeping the ends of web 12 engaged around the curvature of the bundle.

As described above, and referring to FIGS. 3, 5 and 6, the underside of head 28 of each hook 22 comprises a substantially flat, and horizontal or canted lower overhanging surface 34 extending outward from a relatively small radius 36 at the junction of the flat surface 34 and pedestal 26. This novel structure provides an increase in overhang beneath the head portion 28 of each hook 22, allowing each loop or loops 14 engaging a hook 22 to have a firm grip on the flat underside 34 of a corresponding hook 22. The flat underside reduces the tendency of a loop 14 to slip off of a captured hook 22, and provides a stronger grip between the ends of the web 12, thereby adding to the force required to separate the two web ends. The combination of a mushroom hook 22 having a flat horizontal (FIG. 5) or canted (FIG. 6) underside 34 for engaging a loop or loops 14 also provides greater pick resistance, whereby loop assembly 10 resists separation if the hook and loop assembly is inadvertently bumped or brushed after being applied to a wire bundle or the like.

Figure 5:
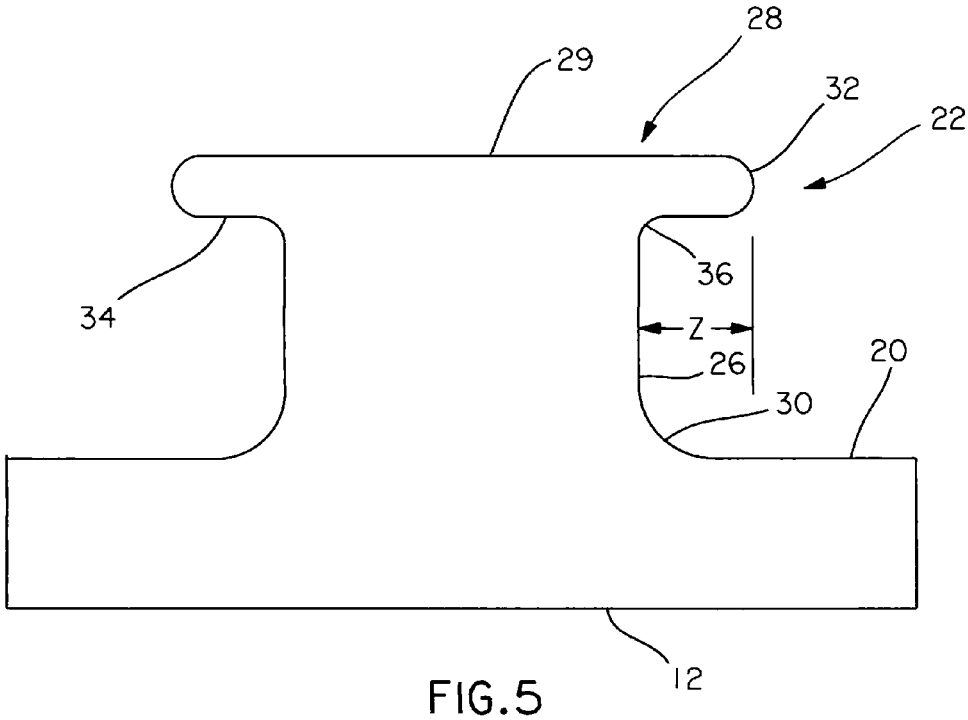
FIG. 5 is a cross-sectional view of a single hook constructed in accordance with an embodiment of the present invention, taken along line V-V in FIG. 2.
Figure 6:
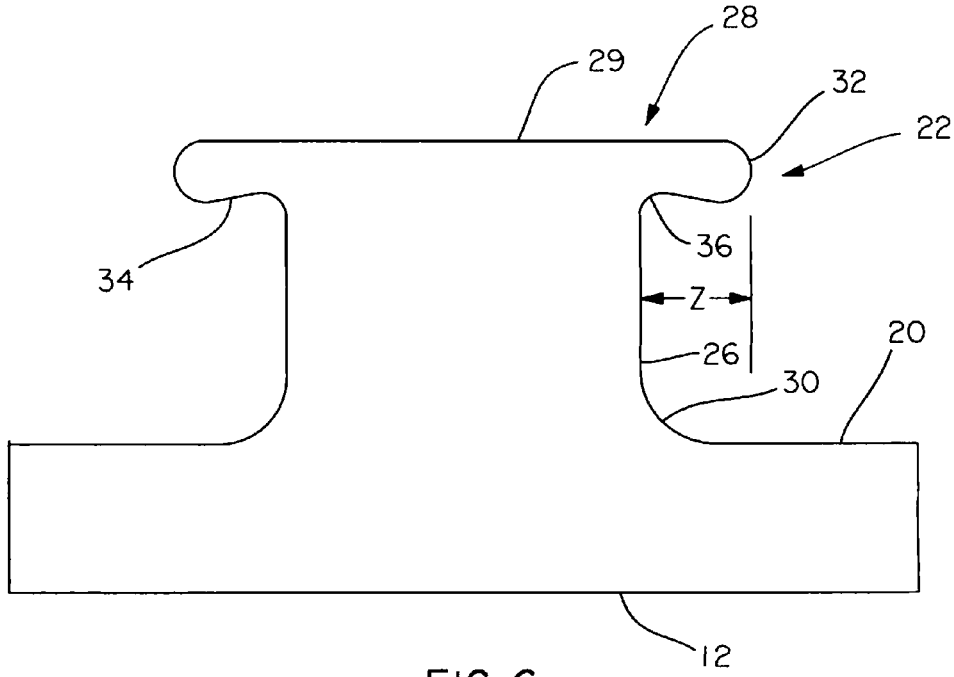
FIG. 6 is a cross-sectional view of a single hook having a downwardly and outwardly extending flat surface on the underside of the head of the hook.

In FIG. 5, the dimension Z designates the radial distance of the overhang provided by flat surface 34. The dimension Z has been empirically determined to be 0.0037 inches, considering use of the assembly 10 as a cable tie, and using polypropylene as the hook material. Dimension Z will vary as the dimensions of hook and loop assembly 10 change, and as the material of composition of the assembly changes.

FIG. 1 illustrates the hook and loop assembly 10 of the present invention, showing the relative position of the loops 14 and mushroom hooks 22 when one end of web 12 is fastened to another portion of web 12. In this condition, when bringing the loops 14 into contact with hooks 22 to fasten the loop and hook assembly 10 together around a wire bundle or other device, single or multiple loops 14 come into contact with each hook 22, whereby some of the loops extend over the head portion 28 of each hook 22, and each loop 14 engages the flat lower surface 34 of each head portion 28. Each hook is a 360° hook, and can engage a single loop or a plurality of loops in any direction. Since the hooks 22 are staggered in the cross-web direction A by ½ X, as explained above, the distance between the tangential edges of rims 32 is increased relative to a non-staggered hook array. This increased distance allows more loops 14 to enter the space between the mushroom hooks, increasing the ability of the loops to positively engage the flat underside 34 of each mushroom hook 22. As the multitude of loops 14 engages the plurality of hooks 22, one end of web 12 becomes removably but firmly attached to another portion of web 12. The construction of the hook and loop assembly, as described above, provides optimum flexibility, peel resistance, pick resistance and the reduction or elimination of flagging when the hook and loop assembly 10 is wrapped around a wire bundle, or other object.

Figure 2:
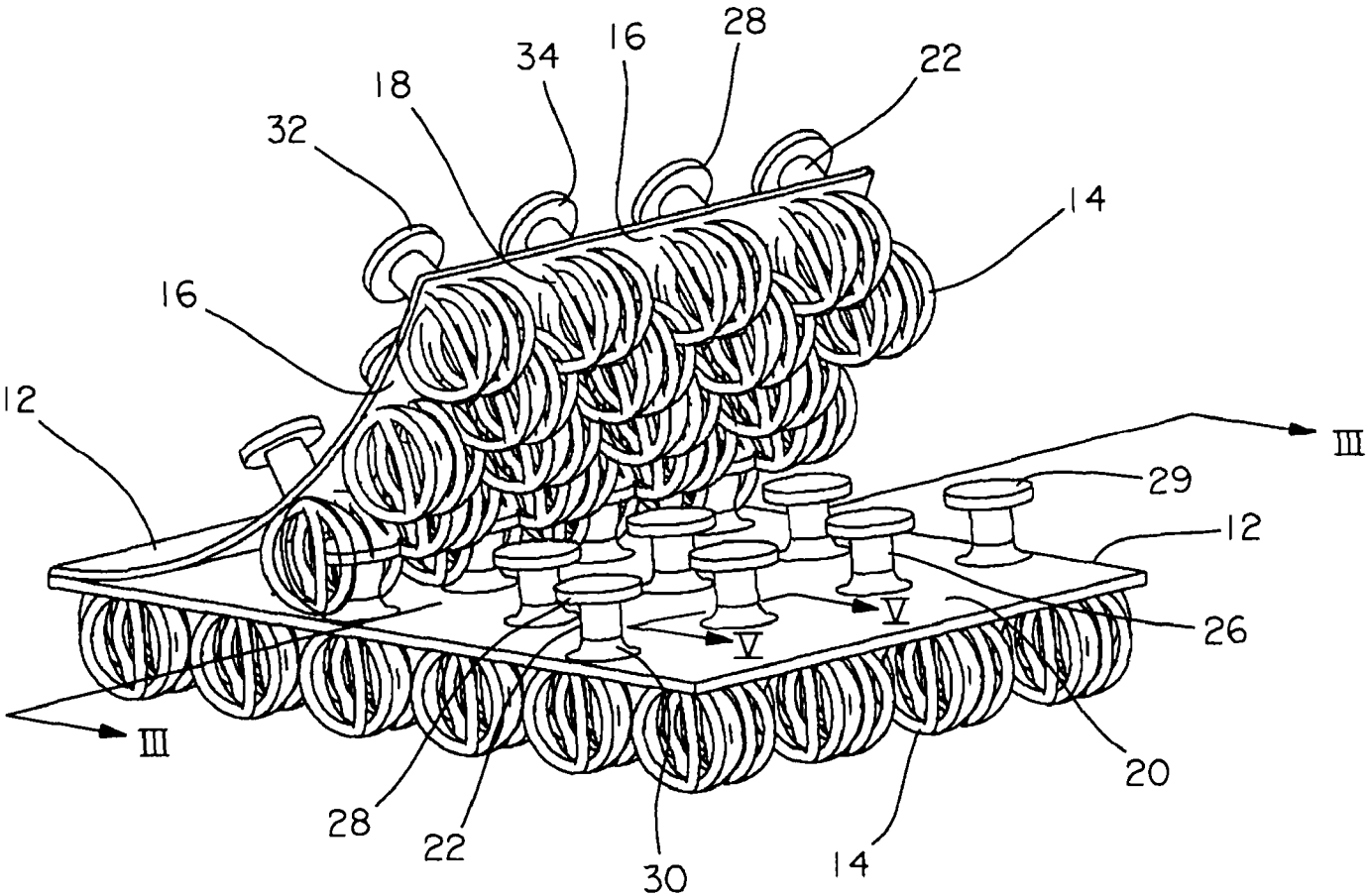
FIG. 2 is a perspective detail view of the ends of the hook and loop fastener assembly of FIG. 1, showing the loops integrally formed with the loop side of the web and the hooks attached to the hook side of the web, the fastener assembly shown in a partially separated position.

When it is desired to disengage the hook and loop assembly, the respective attached ends of loop web 12 are manually or otherwise separated, as illustrated in FIG. 2, by lifting and peeling away one of the web ends upward and away from the other web end. The web ends will then be in the position shown in FIG. 2. Each loop 14 that previously engaged the under surface 34 of a hook 22 is stretched until the loop 14 extends around rim 32 of a corresponding hook 22, and the loop becomes detached from the hook as the loop slips off of the hook. During this detaching process, it has also been observed that disc or head portion 28 of an engaged hook 22 will deform in an upward direction under the force of a loop 14 being removed from the hook 22 and disengaging from flat underside surface 34 of the hook. Additionally a loop 14 may break and release itself from a corresponding hook 22. This process continues until all of the loops 14 are disengaged from a corresponding hook 22, and the respective ends of web 12 are separated from each other.

Utilizing the staggered hook array of the present invention shown in FIG. 4, the hook and loop assembly 10 has increased peel capability, resulting in a smoother separation of one end of web 12 from the other end of the web. This is due to the fact that during the disengagement process, no mushroom hook 22 is directly ahead of a loop 14 disengaged from a previous row of hooks 22. Additionally, the distance Y between hooks 22 (FIG. 4) is increased as previously described. Thus, a loose loop 14 is not in an advantageous position to re-engage with another hook 22 during the peeling process.

Additionally, the density of hooks 22 in the cross-web direction A exceeds the density of hooks 22 in the machine direction B, since $Y \approx X+0.25X$. This provides a greater space in which more loops 14 can fall between and become engaged with hooks 22 during the fastening process, thus adding to the peel resistance strength of the fastened ends of web 12. Additionally, the staggered array of hooks between rows 38 and 40 provides an increased linear distance between the mushroom hooks of adjacent rows 38 and 40, making it easier for loops 14 to enter the space between mushroom hooks 22 and become engaged with the hooks, increasing peel strength.

While the invention has been shown and described in conjunction with specific exemplary embodiments, the invention is not limited to these. It will be obvious to those skilled in the art that changes and modifications may be made without departing from the teachings of this invention and that the matter set forth in the foregoing description and accompanying drawings is offered by way of illustration only and not as a limitation. The actual scope of the invention is intended to be defined in the following appended claims.

What is claimed is:

1. A microhook and loop fastening and detaching assembly comprising:

a. a flexible web including a plurality of malleable loops attached to the web;

b. the web having a plurality of hooks attached thereto, said loops adapted to removably engage said hooks;

c. the hooks and loops arrayed back to back on opposite surfaces of the web;

d. said hooks equidistantly arrayed in a plurality of linear rows on the web, said linear rows extending across the width of the web, a first predetermined space disposed widthwise between adjacent hooks in each said linear row, said hooks arrayed in a staggered manner relative to the hooks of each adjacent linear row, each adjacent linear row located in a direction along the length of the web, with each hook in a first widthwise row having a lengthwise centerline located between the centerlines of a pair of hooks in an adjacent second widthwise row, a second predetermined lengthwise space disposed between hooks in each adjacent row;

e. said second predetermined lengthwise space being greater than said first predetermined widthwise space;

f. said first and second predetermined spaces adapted to receive a plurality of said loops upon fastening said assembly.

2. The microhook and loop fastening and detaching assembly of claim 1, wherein:

said lengthwise centerline of said hooks in said first widthwise row are equidistant from the lengthwise centerline of two adjacent hooks in said second widthwise row, said lengthwise centerline of said hooks extending in the lengthwise direction of said web.

3. The microhook and loop fastening and detaching assembly of claim 1, wherein:

the lengthwise centerline distance between hooks in said first row and said second row is substantially twenty-five percent greater than the widthwise centerline distance between the hooks in said linear rows extending across the width of said web.

4. The microhook and loop fastening and detaching assembly of claim 1 wherein:

said flexible web comprises a knitted fabric material.

5. The microhook and loop fastening and detaching assembly of claim 1, wherein:

each of said loops are flexible and tend to maintain a random open shape when said loops are in an unstressed configuration.

6. The microhook and loop fastening and detaching assembly of claim 1, wherein:

said lengthwise distance between hooks in adjacent linear rows is twenty-five percent greater than said predetermined widthwise distance between adjacent hooks in the same linear row.

* * * * *

UNITED STATES PATENT AND TRADEMARK OFFICE

CERTIFICATE OF CORRECTION

PATENT NO. : 8,256,068 B2
APPLICATION NO. : 12/262376
DATED : September 4, 2012
INVENTOR(S) : David W. West It is certified that error appears in the above-identified patent and that said Letters Patent is hereby corrected as shown below:

In the Specification

Col. 3, Line 11 "...to accomodate stress..." should read "...to accommodate stress..."

Signed and Sealed this
Eighteenth Day of March, 2014

Michelle K. Lee

Michelle K. Lee
*Deputy Director of the United States Patent and Trademark Office*